United States Patent [19]

Ditzig

[11] 3,965,320

[45] June 22, 1976

[54] PUSH BUTTON SWITCH

[75] Inventor: Albert F. Ditzig, Hoffman Estates, Ill.

[73] Assignee: Molex Incorporated, Lisle, Ill.

[22] Filed: Oct. 17, 1974

[21] Appl. No.: 515,586

[52] U.S. Cl. ..... 200/314; 200/159 A
[51] Int. Cl.[2] ..... H01H 9/00
[58] Field of Search ..... 200/314, 159 R, 159 A, 200/156

[56] References Cited

UNITED STATES PATENTS

| | | | |
|---|---|---|---|
| 2,978,555 | 4/1961 | Jones | 200/159 R |
| 3,045,501 | 7/1962 | Wright | 200/156 |
| 3,157,771 | 11/1964 | Roeser | 200/314 |

*Primary Examiner*—Gene Z. Rubinson
*Assistant Examiner*—Morris Ginsburg
*Attorney, Agent, or Firm*—Louis A. Hecht

[57] ABSTRACT

A double pole, double throw, lighted push button switch having a switch housing receiving a central support member. A light assembly is provided which can be either independently or dependently connected to an electrical circuit and is mounted on top of the support member. A switch blade assembly is connected to the circuit and mounted within the housing and is movable between a normal position and an unstable position whereby electricity is allowed to flow through a load in the circuit in one position and is allowed to flow through another load when in the other position. An actuator assembly is provided for moving the contact assembly from its normal position to its unstable position. The actuator assembly includes a depressable push button mounted for reciprocal movement, a pawl member, a rotatably mounted ratchet member, and a reciprocally mounted positioner member. The pawl member is associated with the push button for movement therewith. The ratchet member is adapted to be engaged by the pawl member so that the ratchet member rotates a given increment every time the push button is depressed. The ratchet member also includes a cam which rotates with the ratchet member. The positioner member is operably associated between the ratchet cam and the switch blade assembly for moving the switch blade assembly between the normal and unstable positions in response to an incremental rotation of the ratchet member. The pawl member is spring-biased by a means separate from the pawl member to return it to its initial position after every depression of the push button. In addition, double pole switching can be effected by mounting essentially the same elements as described above on the other side of the central support member.

7 Claims, 9 Drawing Figures

FIG. 2

FIG. 1
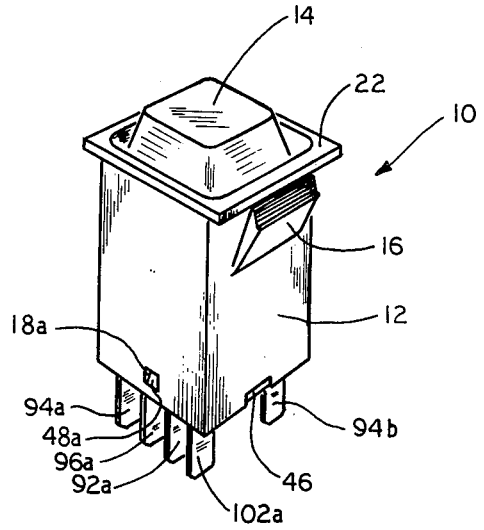
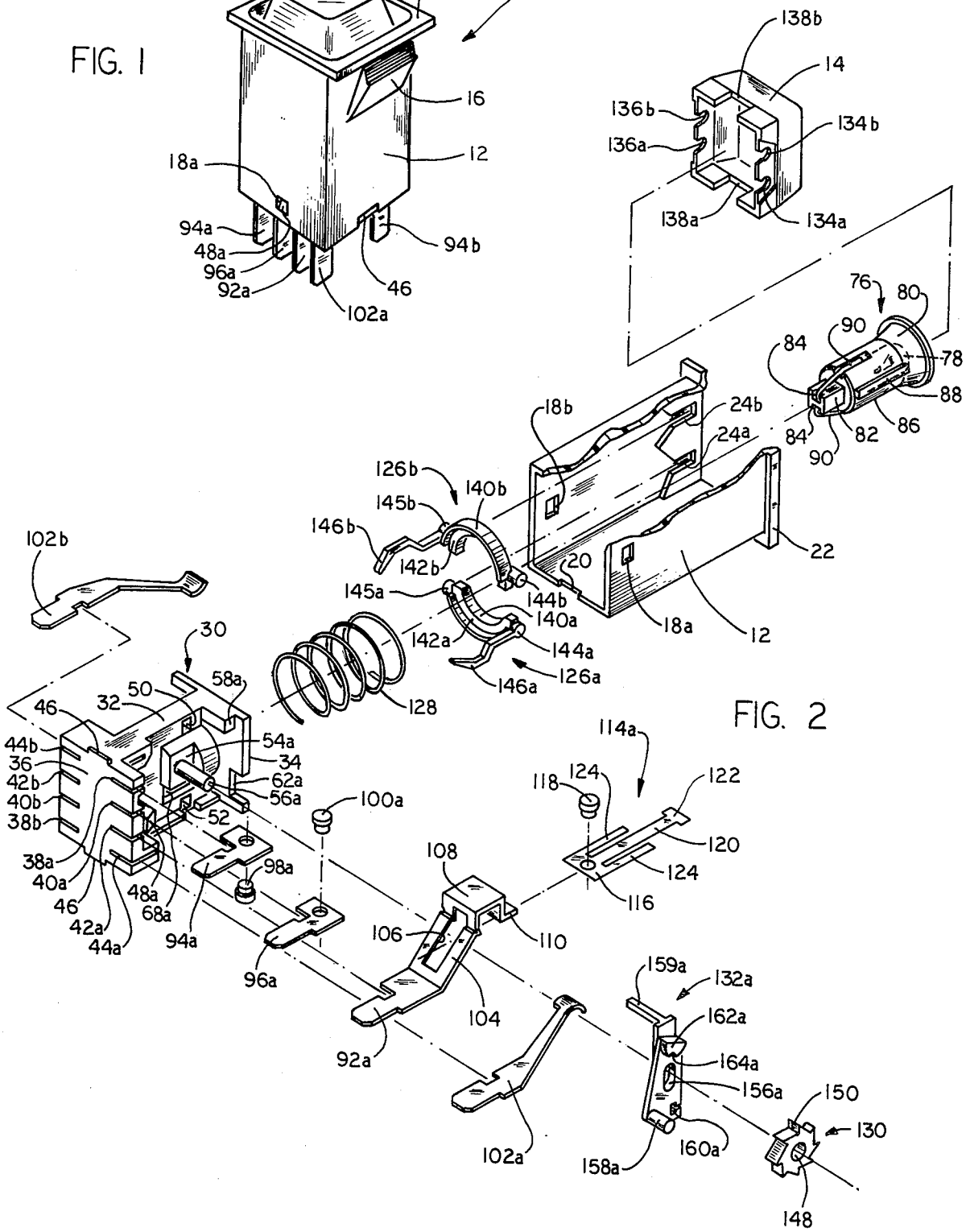
FIG. 2

FIG. 6
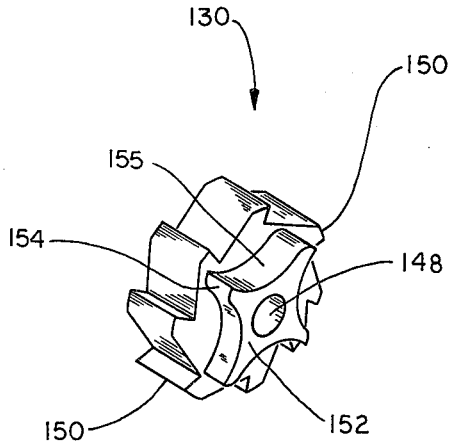
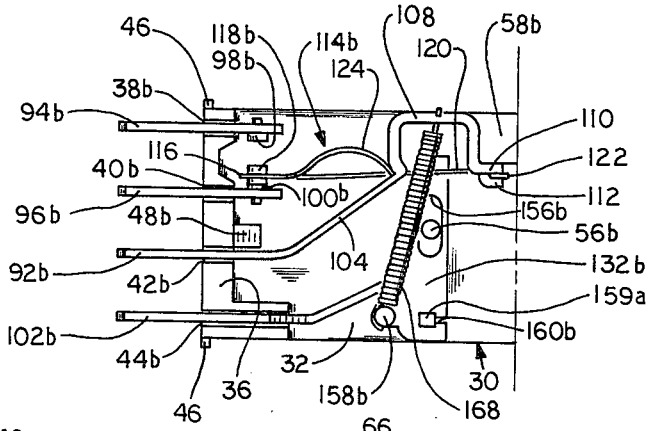
FIG. 7
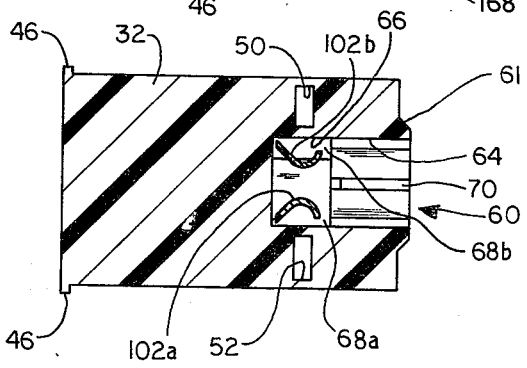
FIG. 9
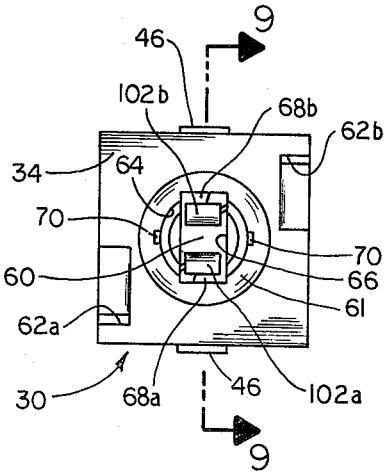
FIG. 8

PUSH BUTTON SWITCH

BACKGROUND OF THE INVENTION

1. Field of the Invention

The present invention relates to a push button switch construction wherein one depression of the push button is effective to close one set of switch contacts and the succeeding depression of the push button is effective to close another set of contacts, the arrangement being such that continued successive plunger depressions to switch a blade from one set of contacts to the other.

2. Brief Description of the Prior Art

In recent years, the push-button type switches have enjoyed an ever growing degree of popularity. Push button switches have a variety of uses such as in appliances or in business machines and can be of the single pole, double throw or double pole, double throw variety, depending on its application. In addition, some push button switches are provided with an indicator such as a light which can be actuated either independently of the switch or dependent on the switch.

Most push button switches have a switch blade assembly connected to a circuit and movable between a normal position and an unstable position so that electricity is allowed to flow through one part of the circuit in one position and another part of the circuit in the other position. An actuator assembly is provided for moving the switch blade assembly from its normal position to its unstable position. One kind of actuator assembly uses a ratchet member and a pawl. The pawl is usually attached to the push button for movement therewith and is an engagement with the ratchet member so that every depression of the push button rotates the ratchet member a given increment. The ratchet member has a cam associated therewith in engagement with the switch blade assembly. Every time the ratchet member is moved a given increment, the cam forces the contact assembly from one position to another position.

The problems most commonly encountered with push button switches of this type are twofold. First there is the cost of manufacture and second, the level of performance. The level of performance is affected due to tease of the part of the switch blade assembly, and the fatigue of the pawl caused by repeated depressions of the push button. In addition, there can be problems of synchronizing two switch blade assemblies in a double pole, double throw switch.

SUMMARY OF THE INVENTION

It is the principal object of the present invention to provide a push switch which has an improved operation without sticking, parts jamming, or teasing and wherein the component parts are low-cost and can be quickly and easily assembled together without expensive machinery or intricate skill on the part of the assembler.

These and other objects of the invention are accomplished by one embodiment of a push button switch currently contemplated, which is connected in an electrical circuit to two loads. The switch generally includes a switch blade assembly and an actuator assembly. The switch blade assembly is connected to the circuit and movable between a normal position and an unstable position whereby electricity is allowed to flow through one load in the normal position and through the other load in the unstable position. The actuator assembly moves the contact assembly from its normal position to its unstable position. The actuator assembly includes a depressable push button mounted to reciprocal movement, a pawl member, a rotatably mounted ratchet member, and a reciprocally mounted positioner member. The pawl member is associated with the push button for reciprocal movement therewith. The ratchet member is adapted to be engaged by the pawl member so that the ratchet member rotates a given increment every time the push button is depressed. The ratchet member also includes a cam which is adapted to engage one end of the positioner member. The positioner member is operably associated between the ratchet cam and the switch blade assembly and moves the switch blade assembly between the normal and unstable positions in response to an incremental rotation of the ratchet member.

Another feature of the present invention resides in the manner in which the pawl member is mounted. More particularly, the pawl member is pivotally mounted on the push button and is biased so that the free end of the pawl member points somewhat toward the center of the ratchet member. The free end of the pawl member will point away from the center of the ratchet member when the push button is depressed and then will return back to its initial position after depression of the push button due to the force of the biasing means.

Still another feature of the present invention resides in an improved switch arrangement for a double pole, double throw push button switch. The arrangement generally comprises two single pole, double throw switches as described above which are mounted on either side of a central support member. The positioner members are connected to one another for simultaneous movement.

BRIEF DESCRIPTIONS OF THE DRAWINGS

FIG. 1 is a perspective view of a push button switch of the present invention;

FIG. 2 is a perspective exploded view of the push button switch of the present invention;

FIG. 6 is an enlarged perspective view of the ratchet member employed in the push button switch of the present invention;

FIG. 7 is an elevational view taken generally along the line 7—7 of FIG. 5;

FIG. 8 is a top plan view of the central support member without the light assembly or push button mounted the reover; and FIG. 9 is a sectional view taken generally along the line 9—9 of FIG. 8.

DESCRIPTION OF THE PREFERRED EMBODIMENT

Figure 3:
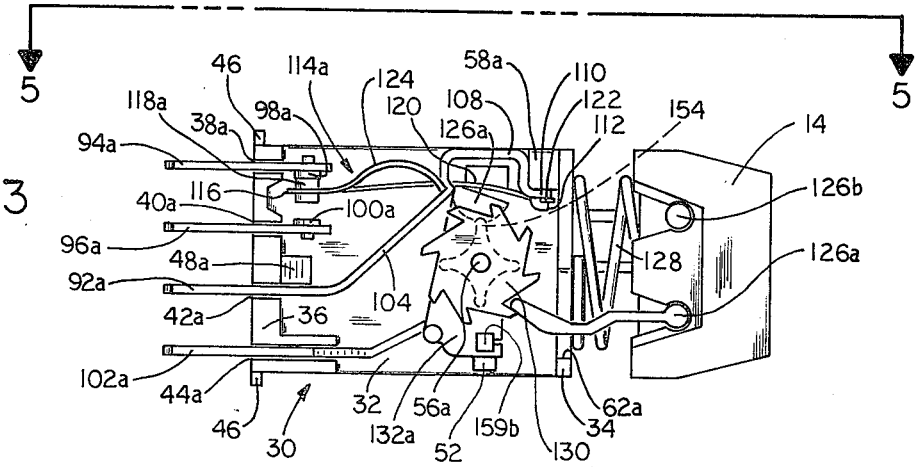
FIG. 3 is an elevational view of the push button switch of the present invention without the housing and wherein the switch blade assembly is in an unstable position.

Turning now to FIG. 1 in greater detail, the switch of the present invention, generally designated 10, is shown. The particular switch 10 to be described herein as the preferred embodiment is a double pole, double throw, independently lighted switch.

The switch 10 has a switch housing 12 with a depressable push button 14 mounted reciprocally therein. One depression of the push button 14 is effective to close one set of switch contacts and the succeeding depression of the push button 14 is effective to close another set of contacts. This arrangement is such that continued successive push button depressions are effective to switch the contacts from one set to the other in order to electrically connect one load or another load into a circuit.

The particular switch 10 shown in FIG. 1 is adapted to be mounted into a suitable opening in a chassis or wall panel (not shown). To this end, there is provided two mounting tabs 16 (only one shown in FIG. 1) which provide a snap fit for the switch housing 12 into the apperature.

The switch housing 12 also includes a pair of square openings 18a and 18b (FIGS. 1 and 2), a pair of rectangular cutouts 20 (only one shown in either of FIGS. 1 and 2), and a generally square top lip 22 defining the periphery of one end of the housing. The lip 22 abuts a chassis or wall panel so that the chassis or wall panel is pressed between the mounting tab 16 and lip 22.

The interior of housing 12 also includes two pair of recesses 24*a* and 24*b* (only one of each pair is shown in FIG. 2). The recesses 24*a* and 24*b* serve to receive some of the components of switch 10 as will be discussed in greater detail hereinafter.

A central support member, generally designated 30, is received within housing 12. The support member 30 is in the configuration of an I-beam and has a web portion 32 joining an actuator flange 34 and a terminal flange 36 at either end thereof. The components comprising each pole of the switch are mounted on either side of the web portion 32. The components on one side are identical to the components on the other side. Therefore, all those components mounted on one side of the web portion 32 or related to a particular pole, will have reference numerals ending with *a* whereas components relating to the other pole will have reference numerals ending with *b*. For the most part, only the components relating to one pole will be described in detail, it being understood that the like components comprising the other pole work in a like manner.

The terminal flange 36 includes four switch terminal slots 38*a*, 38*b*, 40*a* and 40*b*, one pair for each pole, two common terminal slots 42*a* and 42*b*, and two lamp terminal slots 44*a* and 44*b*, (FIG. 2). The terminal flange 36 also includes two bottom tabs 46 (FIG. 2) and a bar 48*a* and 48*b*, which are extendable into square openings 18*a* and 18*b* respectively in the switch housing to provide a snap fit of the central support member 30 into the housing 12. The tabs 46 are received in the cutouts 20 in the housing 12 as best shown in FIG. 1.

Web portion 32 has two slots 50 and 52 extending there through and appearing on each side thereof. Each side of web 32 has a positioner receiving area 54*a* and 54*b* with a pin 56*a* and 56*b* extending outwardly therefrom respectively, and located between the two slots 50 and 52.

Another bar 58*a* and 58*b* is formed on the side of the actuator flange 34 facing the web portion 32. The other side of the actuator flange 34 includes a socket cavity 60 formed therein and extending partially into the web portion 32 as best seen in FIG. 8. An annular ridge 61 is formed on the actuator flange around the periphery of the socket cavity 60. A pair of rectangular cutouts 62*a* and 62*b* are formed in the actuator flange 34 to allow mechanical communication between one side of the actuator flange 34 to the other side thereof.

The socket cavity 60 has a generally cylindrical portion 64 extending from a generally rectangular or wedged shaped portion 66. The rectangular portion 66 has openings 68*a* and 68*b* formed therein. The cylindrical portion 64 has aligning recesses 70 formed therein.

Looking now at FIG. 2, a light assembly, generally designated 76, is provided to fit into the socket cavity 60. The light assembly 76 includes a lamp bulb 78 which is received in a plastic socket 80. Socket 80 has a generally rectangular base 82 which is adapted to fit in the rectangular portion 66 of the cavity 60 and has a pair of openings 84 formed in the bottom thereof. The socket 80 also has a cylindrical portion 86 having guide ridges 88 formed thereon which are adapted to be received in the aligning recess 70 in the socket cavity 60.

The bulb 78 has two electrical uninsulated leads 90 which are received through openings 84 and are wrapped around the socket as shown in FIG. 2. When the light assembly 76 is received in the socket cavity 60, the light bulb leads 90 are each in close proximity to openings 68a and 68b formed in the base portion 66.

Each pole of switch 10 includes a common terminal 92*a* and 92*b*, two switch terminals 94*a*, 94*b*, 96*a* and 96*b* each having a contact rivet 98*a*, 98*b*, 100*a* and 100*b* mounted thereon respectively. In addition, a pair of lamp terminals are provided 102*a* and 102*b*. Common terminals 92*a* and 92*b* are mounted in slots 42*a* and 42*b* respectively; switch terminals 94*a*, 94*b*, 96*a*, and 96*b* are mounted in slots 38*a*, 38*b*, 40*a* and 40*b* respectively; and lamp terminals 102*a* and 102*b* are mounted in slots 44*a* and 44*b* respectively.

The terminals are connected in an electrical circuit in a conventional manner. That is, each common terminal 92*a* and 92*b* is connected to ground; each switch terminal 94*a* and 94*b* is connected to a given load in the circuit; each switch terminal 96*a* and 96*b* is connected to another load in the circuit; while lamp terminals 102*a* and 102*b* are connected to another portion of the circuit independent of the loads.

As is best seen in FIG. 2, each common terminal 92*a* and 92*b* has a slanted portion 104 with a rectangular slot 106 formed therein. Each common terminal 92*a* and 92*b* also has a bent portion 104 adapted to fit around bar 48*a* and 48*b* respectively. The end 110 of the common terminal 92*a* and 92*b* adjacent the bent portion 108 has a pair of spaced hooks 112 formed thereon.

A switch blade assembly, generally designated 114*a* and 114*b* (FIG. 2), is provided to establish electrical contact between each common terminal 92*a* and 92*b* and either each switch terminal 96*a* and 96*b* or each switch terminal 94*a* and 94*b* respectively. Looking at FIG. 2, each switch blade assembly 114*a* and 114*b* is seen generally to include a movable end 116 having a contact rivet 118 mounted thereon. A central blade 120 extends from the movable end 116 and has a T-shaped portion 122 formed at the free end thereof. Two side blades 124 also extend from the movable end 116 on either side of the central blade 120. The side blades 124 are shorter than the central blade 120.

The T-shaped end 122 of the central blade 120 is received through the rectangular slot 106 of each common terminal 92*a* and 92*b*. The T-shaped end 122 is then received within the pair of hooks 112 at the end of each common terminal 92*a* and 92*b*. When each switch blade assembly 114*a* and 114*b* is thus mounted, the side blades 124 are biased against each commmon terminal 92*a* and 92*b* respectively on either side of the slot 106 as best shown in FIGS. 3 and 4.

Figure 4:
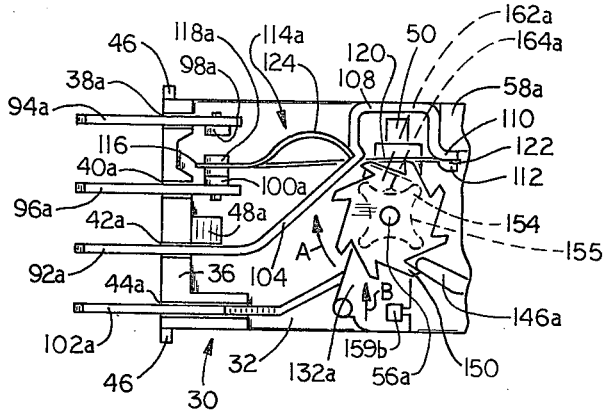
FIG. 4 is an elevational view of the push button switch of the present invention without the housing and wherein the switch blade assembly is in a normal position.

Each switch blade assembly 114*a* and 114*b* is movable between a normal stable position as shown in FIG. 4 wherein each contact rivet 118*a* and 118*b* touches contact rivet 100*a* and 100*b* respectively and an unstable position as shown in FIG. 3 wherein each contact rivet 118*a* and 118*b* touches contact rivet 98*a* and 98*b* respectively. Each switch blade assembly 114*a* and 114*b* goes from its normal to its unstable positions in a snap action fashion whenever a force is applied to the central blade 120 near the bent portion 108 of the common terminal 92*a* and 92*b*. The switch blade assembly 114*a* and 114*b* snaps back to its normal position whenever the force is removed.

The lamp terminals 102*a* and 102*b* extend from the terminal flange 36 into the socket cavity 60 through openings 68*a* and 68*b* respectively. (FIGS. 8 and 9). The ends of lamp terminals 102*a* and 102*b* are adapted to engage bulb leads 90 thereby providing means of providing electrical power to lamp bulb 78.

An actuator assembly is provided to produce the selective force against each switch blade assembly 114*a* and 114*b* in order to change it from one position to another. The actuator assembly generally includes the push button 14, a pair of actuator members 126*a* and 126*b*, a coil spring 128, a ratchet member 130, and a pair of positioner members 132*a* and 132*b*. (See FIG. 2).

Looking now at FIG. 2, the push button 14 is generally hollow, forming a housing for the light bulb assembly 76 and is made of generally translucent material. The button 14 has two pairs of slots 134*a*, 134*b*, 136*a*, 136*b*, and a pair of rectangular cutouts 138*a* and 138*b*.

Each actuator member 126*a* and 126*b* is seen to generally include a generally semi-annular collar 140*a* and 140*b* having a semi-annular recess 142*a* and 142*b* and a pair of pins 144*a*, 144*b*, 145*a* and 145*b* respectively. The pins are snap-fit into slots 134*a*, 134*b*, 136*a*, and 136*b*, respectively, in the push button 14. When thus mounted, the actuator members 126*a* and 126*b* are pivotally mounted in the push button and form an annular collar having an annular recess. Pins 144*a*, 144*b*, 145*a* and 145*b* are received within the two pair of recesses 24*a* and 24*b* respectively. (FIG. 2). The cutouts 138*a* and 138*b* in the push button 14 are provided for clearance for pivotal movement of the actuator members 126*a* and 126*b*.

Each actuator member 126*a* and 126*b* has a pawl portion 146*a* and 146*b* respectively which extends from the collar into housing 12 through cutout 62*a* and 62*b* respectively formed in an actuator flange 34. The pawl portion 146*a* is adapted to engage ratchet member 130. Inasmuch as only one ratchet member 130 is required, (as will be discussed hereinafter) and it is engaged by pawl portion 146*a*, pawl portion 146*b* engages nothing. However, because both actuator members 126*a* and 126*b* are identical, it is cheaper to manufacture two identical parts rather than one actuator member having a pawl portion and another actuator member having no pawl portion, although this can be done.

Looking at FIG. 6, the ratchet member 130 has a purality of ratchet teeth 150 formed on the periphery thereof. A central opening 148 is provided to receive pin 56*a* thereby rotatably mounting ratchet member to web portion 32.

A cam 152 is formed on the back of the ratchet member 130 and has a generally regular configuration of a gradual radially extending points 154 and depressions 155. These radially extending points 154 occur every two teeth on the ratchet member 130. The cam surface is adapted to engage one end of the positioner member 132*a*.

Turning now to FIG. 2, each positioner member 132*a* and 132*b* is seen to generally include a slot 156*a* and 156*b*, a spring stub 158*a* and 158*b*, a connecting stub 159*a* and 159*b*, a keyhole 160*a* and 160*b* and a cam follower portion 162a (only one cam-follower portion shown) having a notch 164*a* (only one notch shown) formed thereon. Each positioner member 132*a* and 132*b* is mounted on the web 32 by receiving pin 56*a* and 56*b* through slot 156*a* and 156*b* respectively. The ratchet member 130 is mounted over positioner member 132*a* on pin 56*a*.

Connecting stub 159*a* is received through slot 50 and is snap-fit into keyhole 160*b*. Connecting stub 159*b* is received through slot 52 and is snap-fit into keyhole 160*a*. Accordingly, positioner members 132*a* and 132*b* are connected to one another through the web 32 for reciprocal movement within the limits prescribed by slots 156*a*, 156*b*, 50 and 52.

Coil spring 128 is employed to return push button 14 back to its initial position after depression. One end of the coil spring 128 is received within the annular recess formed in the two semicircular collars 140*a* and 140*b*. The other end of the coil spring 128 is received around the periphery of the annular ridge 61 formed around socket cavity 60. The biasing force of coil spring 128 causes the pawl portions 146*a* and 146*b* of each actuator member 126*a* and 126*b* to be urged toward each other. However, during depression of the push button 14, the pawl 146*a* will tend to move outwardly with the ratchet member 130 against the biasing force. When the push button 14 is released, the coil spring 128 will automatically return the pawl to its initial position to engage the next successive ratchet tooth 150. This eliminates the need of a flexible pawl element which is usually the weakest part in a switch of this kind.

It has been found that it is not necessary to use two ratchet members 130, one for each pole, to effect synchronous double pole switching because of the interconnection of positioner members 132*a* and 132*b*. However, another spring 168 is connected between the spring stub 158*b* and the bent portion 108*b* of the common terminal 92*b* to aid in synchronous double pole switching. Thus, when switch blade assembly 114*a* goes from one position to another position, the switch blade assembly 114*b* will do likewise at the same time.

Figure 5:
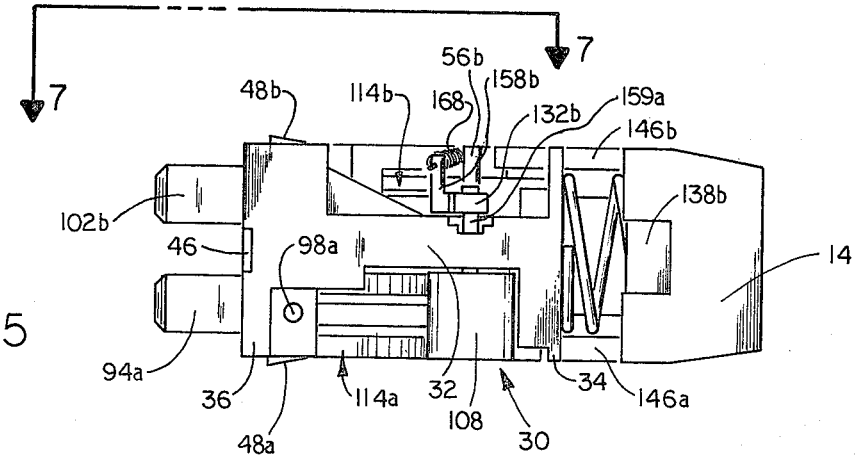
FIG. 5 is an elevational view taken generally along the line 5—5 of FIG. 3.

In operation, the switch 10 will change current from one load to another load, when the push button 14 is depressed. Looking at FIG. 4, the switch blade assembly 114*a* is in its normal stable position. Upon depression of push button 14, pawl portion 146*a* will move downwardly and engage a ratchet tooth 150 causing ratchet member 130 to rotate one tooth increment in the direction indicated by arrow A of FIG. 4. When ratchet member 130 moves one increment, the point on cam 152 pushes the cam follower portion 162a and, therefore, the positioner member 132*a* in the direction indicated by arrow B indicated in FIG. 4. When this occurs, the cam follower portion 162*a* pushes central blade 120 in the direction indicated by arrow B thereby causing the switch blade assembly 114a to move from the position shown in FIG. 4 to its unstable position, shown in FIG. 5. Upon release of the push button, the coil spring 128 will force the push button upwardly to its initial position and urge the actuator members 126*a* and 126*b* back to their initial positions.

The switch blade assembly 114*a* will remain in the unstable position shown in FIG. 3 because the cam point 154 is received in notch 164 of the cam follower portion 162*a* which prevents rotation of the ratchet member 130. Upon the next successive depression of push button 14, the ratchet member 130 will be rotated another increment. Because the switch blade assembly 114 is biased in the direction opposite that indicated by arrow B in FIG. 4, the cam follower portion 162*a* of actuator member 132*a* moves into the depression 155 of the cam 152 in a direction opposite that indicated by arrow B.

Because of the interconnection of positioner members 132*a* and 132*b* as described above, switch blade assembly 114*b* will simultaneously move in the same manner as switch blade assembly 114*a*. Thus, efficient and reliable double pole switching is effected.

It is to be understood that even though the preferred embodiment herein is for an independently lighted, double pole, double throw push button switch, the invention disclosed herein does not require all the elements disclosed. For example, the light assembly need not be independently actuable. It could be a dependent light which illuminates to show when the switch blade assemblies 114*a* and 114*b* are in one position or the other position. Moreover, it is not necessary that a light assembly be included at all. Also, it can be appreciated that it is not necessary that the push button switch of the present invention be in the form of a double pole, double throw switch. The same concept is equally applicable to a single pole double throw switch. All that is required in a single pole switch is to eliminate some of the components or the other side of the web portion 32 of the central support member 30.

I claim:

1. In a lighted push button switch for use in an electrical circuit including at least one switch blade assembly connected to said circuit having a switch blade movable between a normal position and an unstable position whereby electricity is allowed to flow through one part of the circuit in one position and another part of the circuit in the other position, said switch blade assembly having terminal components connectable to the circuit, an actuator assembly for moving the switch blade from its normal position to its unstable position having a depressable push button mounted for reciprocal movement, a switch housing encasing said switch blade assembly and said actuator assembly, and support means within said housing mounting said switch blade assembly and said actuator assembly, the improvement in said support means comprising:

a single unitary support member removably mounted within the housing, said support member including vertical web means dividing the interior of the housing into a plurality of portions, each portion capable of mounting a switch blade assembly thereon, a horizontal actuator mounting portion at one end of the web means associated with the actuator assembly, and a horizontal terminal mounting portion at the other end having terminal slots for mounting the terminal components, said terminal mounting portion being flush with the other end of the housing defining the bottom of the switch.

2. The switch of claim 1 wherein said actuator assembly includes a pawl member associated with the push button for movement therewith, a rotatably mounted ratchet member on said web means adapted to be engaged by said pawl member so that said ratchet member rotates a given increment every time said push button is depressed, said ratchet member including a cam mounted for rotation therewith, and a positioner member mounted on said web means positioned directly between said cam and said switch blade for directly engaging and moving said switch blade between its normal and unstable positions in response to an incremental rotation of the ratchet member.

3. The switch of claim 2 wherein said pawl member is pivotally mounted on said push button for movement therewith, said pawl member being pivotably movable between a normal position and a pivoted position in response to the depression of the push button, said actuator assembly further including biasing means associated between said push button and pawl member for simultaneously returning said push button to its initial position after depression and for pivoting said pawl member from its pivoted position to its initial position after depression of the push button.

4. The switch of claim 2 wherein said support member is generally I-shaped and said web means includes a single central vertical wall dividing the interior of the housing into two portions wherein said switch blade assembly is mounted in one of said portions.

5. The switch of claim 4 including a second switch blade assembly mounted on the other side of the web wall and a second positioner member mounted on the other side of the web wall.

6. The switch of claim 5 wherein said second positioner member is connected to the first positioner member for movement therewith.

7. The switch of claim 1 wherein said push button is made of translucent material, said support member including a socket cavity formed in the actuator portion, said switch including a light bulb assembly mounted in said socket cavity so that said push button is the only structure extending from one end of the housing.

* * * * *